US005392530A

United States Patent [19]

Izumi

[11] Patent Number: 5,392,530

[45] Date of Patent: Feb. 28, 1995

[54] METHOD OF SEASONING LUMBER

[76] Inventor: Hyogo Izumi, Kobe Portvillage No. 3-604, 1-2, Minatojimanaka-machi 3-chome, Chuou-ku, Kobe-city, Hyogo 650, Japan

[21] Appl. No.: 945,981

[22] PCT Filed: Mar. 4, 1992

[86] PCT No.: PCT/JP92/00258

§ 371 Date: Nov. 4, 1992

§ 102(e) Date: Nov. 4, 1992

[87] PCT Pub. No.: WO92/15435

PCT Pub. Date: Sep. 17, 1992

[30] Foreign Application Priority Data

Mar. 4, 1991 [JP] Japan ..... 3-123191

[51] Int. Cl.[6] ..... F26B 5/04

[52] U.S. Cl. ..... 34/404; 34/411; 34/92

[58] Field of Search ..... 34/15, 16.5, 9.5, 92, 34/415, 402–405, 409, 411, 412, 396

[56] References Cited

U.S. PATENT DOCUMENTS 2,548,403 4/1951 Smith ..... 34/16.5
3,921,309 11/1975 Nakayashiki ..... 34/9.5
3,959,529 5/1976 Winn et al. ..... 34/9.5
4,343,095 8/1982 Rosen et al. ..... 34/16.5

FOREIGN PATENT DOCUMENTS 56-154012 11/1981 Japan .
57-4706 1/1982 Japan .
57-165206 10/1982 Japan .
2-98404 4/1990 Japan .

*Primary Examiner*—Denise L. Gromada

[57] ABSTRACT

A three step process to season lumber to reduce cracks in the lumber and reduce warping of the lumber. In a first step, the lumber is piled up into a pressure vessel for seasoning. The vessel is charged with saturated steam, the pressure of which fluctuates within the pressure vessel. This is done to enable any contained water within the vessels capillary tubes and cell cavities to evaporate at the same rate. Thereafter, as a second step the lumber is taken out of the pressure vessel in order to allow free water to evaporate from the lumber. The lumber in a third step is placed into the pressure vessel again and charged by a super saturated steam by using a flow of super saturated steam until remaining water is evaporated, thus forming lumber that is seasoned.

8 Claims, 1 Drawing Sheet

METHOD OF SEASONING LUMBER

This invention relates to a method of seasoning lumber, and more particularly to a method of seasoning lumber, which eliminates any crack and warp occurring during the whole process from raw wood to seasoned lumber, and also reduces seasoning time in a dryer by using superheated steam, thus raising the turnover ratio of the dryer.

BACKGROUND OF INVENTION

Raw wood must be seasoned to be used as a lumber product and the are three conventional process methods of seasoning lumber as follows;

(1) The tunnel kiln method of seasoning lumber used in the Continent of America, wherein hot air is blown on lumber, and dischanged from the both ends of the tunnel.

(2) The method of seasoning lumber using a hot air dryer after prolonged natural seasoning. This method is used in Europe, Japan, and many other countries.

(3) The lumber seasoning method known as steaming and vacuum method, which uses a pressure vessel and repeats pressurizing and heating with saturated steam and reducing pressure to less than the atmospheric pressure.

According to process (1) described above, enormous loss due to cracks and warps occurs and moisture content doesn't become uniform. Moreover when the moisture content falls and the contained water becomes difficult to evaporate, this method cannot enhance reduction of moisture content, resulting in a disadvantage whereby the tunnel kiln must be greatly lengthened.

On the other hand, method (2) described above, is a common lumber seasoning method used in many areas of the world. The greatest possible care is taken to operate the hot air wood dryer so as to reduce loss due to cracks and warps in the lumbar. However, much loss due to cracks and warps occurs during natural seasoning before artificial seasoning, and such problems are regarded as inevitable and have not yet been solved.

Moreover, method 3 described above is a lumber seasoning method which repeats the cycles, and includes the process of heating and pressurizing with saturated steam, and also the process of reducing the pressure below the atmospheric pressure. Thereby depreciation costs a great deal and moisture content within lumber cannot be reduced below 20%. The reason is, during the process of pressurizing and heating, the water contained within lumber is forced to move into the core portion, thereby low-temperature water lump arises. Since the specific heat of the water is three times as large as that of the lumber, even if the time of pressurizing and heating is extended as long as possible, the temperature within said lumber doesn't become uniform. In the case of reducing pressure while the temperature remains non-uniform, the contained water boils and evaporates only from the surface of the lumber. Therefore taking the quantity of heat into account, even if the time of reducing pressure below the atmospheric pressure is extended, the contained water does not boil, resulting in absorption of the evaporated water from the surface of the material. Therefore, the above-mentioned condition equals to that of reducing the contained water with the hot air wood dryer, and a pressurizing and heating process and a pressure reducing process must be repeated many times with the result that method 3 has fallen into disuse due to the expense of seasoning the lumber.

DISCLOSURE OF THE PRESENT INVENTION

The object of the present invention is to provide a lumber seasoning method, which avoids the occurrence of cracks and warps to the lumber and raises the turnover ratio of the dryer.

Examining the reasons why foregoing seasoning methods 1, 2 and 3 described above, don't meet the above-mentioned object, the following common defects thereof are found.

First, tissues containing water within lumber are roughly divided into vessels, capillary tubes, and cell cavities. Water contained in the vessels is evaporated easily, but the capillary tubes have narrow parts through which only particles as large as water molecules can pass and the cell cavities are bagged. Water contained in the capillary tubes and cell cavities is impossible to evaporate except through a small pit. Therefore, in any of the seasoning methods of methods 1, 2 and 3, the contained water is evaporated in a different manner among every tissues with the result that the moisture content within whole lumber is reduced uniformly. Moreover, since the contraction of the lumber occurs with the reduction of moisture content, unequal reduction of said moisture content causes the uneven contraction resulting in the occurrence of cracks and warps to said lumber. In order to avoid these conditions; pretreatment, which enables contained water in vessels, capillary tubes, and cell cavities to be evaporated at the same rate at any seasoning process, is necessary, but such a pretreatment isn't used at present.

Second, much loss due to cracks and warps occurs to lumber when the temperature of the heating air is raised in the high moisture content, and when saturated steam is used as a heating gas and the applied pressure is raised, cell cavities contract and the contained water becomes difficult to evaporate. Contrary to these conditions, as free water within lumber is evaporated and the whole moisture content becomes below 22%, each tissue of said lumber becomes strong, and even if the pressure applied to said lumber is raised gradually, the cell cavities do not contract. Therefore, instead of seasoning, first process is applied, and by adapting the natural seasoning process or ones similar to it until free water evaporates, it could prevent from cracks and warps and also, turnover ratio of the dryer can be increased. However, these methods and results are not achieved by the conventional processes of treating lumber.

Third, whichever seasoning process is used after free water is evaporated from the lumber, the reduction rate of the moisture content becomes very slow and it becomes difficult to reduce the moisture content. Also, when air is used as the heating gas, it is very difficult to avoid the occurrence of the cracks and warps to the lumber, therefore, increasing the reduction rate cannot be done by raising the temperature and velocity of said heating air because of the limitation thereof. Moreover, when saturated steam is used as heating gas in order to avoid the occurrence of cracks and warps to the lumber, the moisture content of the lumber is not reduced below 20% even if the process of reducing pressure is added. Contrary to this, in the case of using superheated steam as heating gas, contained water is capable to be promoted to evaporate without the loss of cracks and warps. Whereby, when the moisture content becomes below 22% at which the reduction rate of moisture content becomes slow, the lumber is strong enough to tolerate high pressure and temperature, simultaneously; in some lumber, the reduction rate of moisture content becomes slow, therefore, it is not considered that the reduction rate of moisture content is possible to be still raised more with the increase of temperature and pressure of the superheated steam.

Accordingly, a method of this invention is to accomplish the above-mentioned objects which comprises the following three steps. The first pretreatment step is piling up and accommodating the lumber to be seasoned into a pressure vessel, charging saturated steam the pressure fluctuates into the pressure of which vessel and, pressurizing and heating so as to enable any contained water within vessels, capillary tubes, and cell cavities to evaporate at the same rate. The second step is taking the lumber out of the pressure vessel and seasoning the lumber by a process such as natural seasoning until free water is evaporated from the lumber. The third step is placing the lumber into the vessel again, charging superheated steam and turning the lumber into seasoned lumber with high-temperature with pressure changes.

According to the method of the invention, at the first step, the pressure of the saturated steam in the pressure vessel is fluctuated and low-temperature water originally contained within the lumber and high-temperature water condensed onto the surface of the lumber are mixed, thereby, the temperature of the new and old water contained within the lumber becomes uniformly high. Therefore, it is possible to make the temperature of the lumber uniformly high including cell cavities within the lumber with the heat transfer of this water at high-temperature. After the temperature within the lumber becomes uniform, the saturated steam is discharged from the pressure vessel and the pressure within the vessel is reduced down to the atmospheric pressure; thereby, all water contained in the lumber boils evenly. Accordingly, by using the phenomenon that the water contained within the lumber boils uniformly, the pretreatment step is to be completed at which all water contained within the tissues of the lumber, such as vessels, capillary tubes and cell cavities, is evaporated uniformly before the commencement of seasoning lumber; thereby, the lumber can be seasoned without the loss due to cracks and warps.

At the foregoing first step, it is preferable to adopt the heating method of increasing the temperature so as not to collect the low-temperature water originally contained within the lumber into the core of the lumber by controlling the charge and discharge of the saturated steam in the above-mentioned pressure vessel and fluctuating the pressure of the saturated steam within a relatively low pressure range of 1–2 atm., then adjusting the temperature of the all water contained within the lumber to uniform temperature at which the water can boil under atmospheric pressure by fluctuating the pressure of the saturated steam within relatively high-pressure range of 1–2 atm.. At the above-mentioned second-step method of increasing temperature, it is appropriate that the relatively low-pressure range is between about 1.2–1.8 kg/cm2 and relatively high-pressure range is between about 1.6–2.0 kg/cm2. While the pressure increases within the above range, the high-temperature water on the surface of the lumber is enclosed within it and during the decrease of the pressure, the low-temperature water in the core of lumber is forced out, thereby, the whole temperature is possible to be unified.

According to the said first step, about 30% of water is evaporated from the lumber, but it is not necessary to repeat the pressuring and heating process and pressure reducing prosess like in a steaming and vacuum method and the object is achieved by reducing the pressure only once.

At the second step following the first, a natural seasoning method or low-temperature seasoning method, which is almost similar to natural seasoning, preferably used because the turnover ratio of the dryer can be raised. When the moisture content within the lumber is high, increasing the temperature of the heating air causes the occurrence of much loss of cracks and warps to the lumber. Also, when saturated steam is used as the heating gas and the applied pressure is raised, cell cavities are compressed and the contained water is difficult to be evaporated. Therefore, such steps cannot be used.

However, the reduction rate of the water contained becomes slow after the free water within the lumber is evaporated, but the lumber becomes strong enough to tolerate high pressure and temperature, so at the third step, the fluctuation of pressure in the vessel is repeated within the fixed range many times by controlling the charge and discharge of the superheated steam and the current of the superheated steam is generated in the vessel. Thereby, it becomes the same state as that by repeating the process of alternating a hot air seasoning method and a vacuum seasoning method, and the reduction rate of the contained water can be raised.

At the above-mentioned third step, the reduction rate of the contained water can be raised still more by reversing the direction of the current of said superheated steam at the lower limit within said fixed range.

The above-mentioned superheated steam is at the temperature between 160° C. and 300° C. and the pressure of about 4 kg/cm2. It is preferable to fluctuate the pressure between 0.8 and 1.2 kg/cm2 within the range of 2.0 kg/cm2 to 4.0 kg/cm2, and the water on the surface can be evaporated during the rise of the pressure and the water within the lumber during the decrease can be discharged.

Therefore, according to the present invention, the loss of cracks and warps can be eliminated, yield of materials can be enhanced, and by raising the turnover ratio of the dryer, the fuel and labor costs can be reduced. Moreover, even if the lumber to be seasoned is thick, it could be seasoned and cut into a desired size after seasoning. Thereby, the yield of wood manufacturing can be increased. Accordingly the cost of wood manufacturing can be reduced.

Next, the foregoing and other features and functions of the present invention are described in detail by referring to the attached drawings and explaining the preferred embodiment of the invention.

BRIEF DESCRIPTION OF THE DRAWINGS

Same reference characters designate both views.

DESCRIPTION OF THE PREFERRED EMBODIMENT

The invention can be described by using the preferred embodiment in which 100 mm square bars or widers having the same thickness, requiring long days to be seasoned according to the lumber seasoning method presently used in the world, whereby, resulting without any loss due to cracks and warps.

Figure 1:
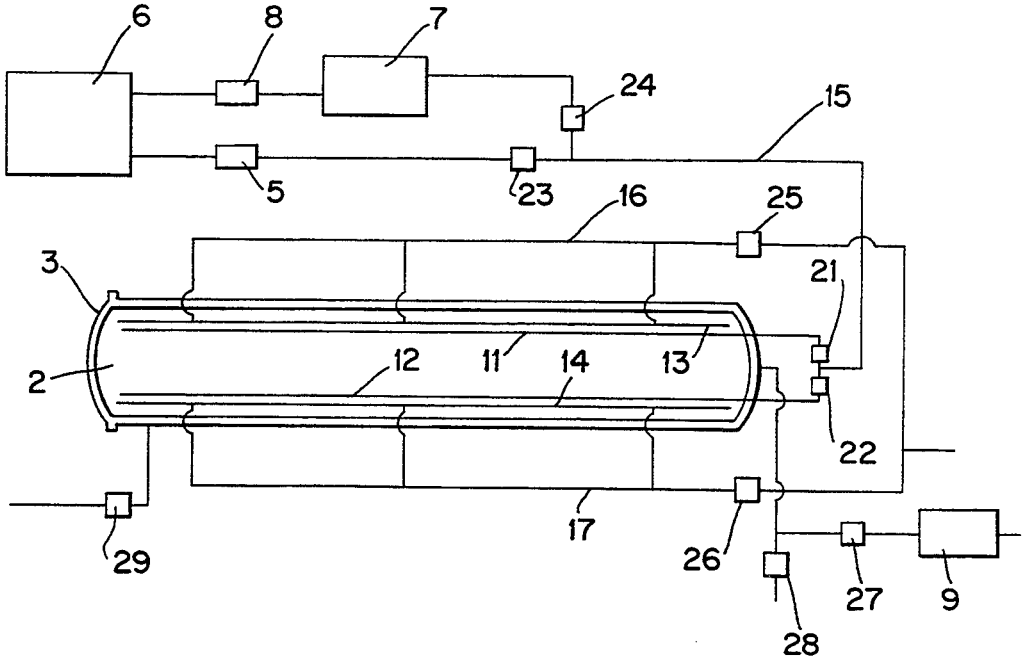
FIG. 1 is a schematic representation of a pressure vessel and an attached equipment used in the invention.
Figure 2:
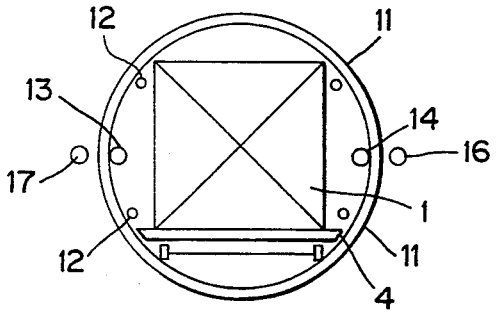
FIG.2 is a schematic cross-sectional view of the pressure vessel shown on FIG. 1.

Referring to the drawings, numeral 2 is a cylindrical pressure vessel having an inner diameter of 1800 mm and a length of 13 m, which comprises a front door 3 and can accommodate piled lumber 1 together with a carriage 2. In an inner wall of the vessel 2, as shown in FIG. 2, injection pipes 11 and 12 having many nozles (not shown) and release pipes 13 and 14 are arranged in the longitudinal direction. As illustrated in FIG. 1, the injection pipes 11 and 12 are connected to a boiler 6 through valves 21 and 22 with common tube line 15 and through a valve 23 and a pressure reducing valve 5. The valve 23 and the pressure reducing valve 5 are also bypassed by a line including a valve 2, a superheater 7 and a pressure reducing valve 8. The release pipes 13 and 12 are lead to the outside through lines 16 and 17 and valves 25 and 26, respectively. The pressure vessel 2 is also connected to a vacuum pump 9 through a valve 27 and leads to the outside through a valve 28. Numeral 29 designates a drain valve of the pressure vessel 2. Next, the embodiment at the first stage of this invention will be described using the foregoing device.

First, lumber to be seasoned with square bars and widers having thickness of 100 mm made of the sawed pine trees, hemlock spruces and white cedars from the Continent of America, which cannot be seasoned with the dryer of tunnel-kiln way used in the Continent of America, is piled on the carriage 4 and sent into the pressure vessel 2 and the front door 3 is closed.

At the first stage, no matter how high the moisture contained within the lumber is, it is feasible, but prerequiste is that free water exists within the lumber.

Next, the valves 22, 25, 26, 27 and 28 are closed, the valves 21, 22, 23, and 29 are opened, and the saturated steam having a pressure of about 4 kg/cm2 and having passed through the pressure reducing valve 5 from the boiler 6 is started to charge into the pressure vessel 2. Then the air within the pressure vessel is discharged from the valve 29. When the amount of the steam discharged from the valve 29 becomes large, the air discharge within the pressure vessel 2 is considered to be completed and the opening of the valve 29 is reduced.

When opening of the valve 29 is reduced, the pressure within the pressure vessel begins to increase. When the pressure within the pressure vessel 2 increases up to about 1.8 kg/cm2, the valves 21 and 22 close automatically and the saturated steam within the pressure vessel stops charging. Since the valve is opened a little, the pressure within the pressure vessel 2 falls. When the pressure falls to about 1.2 kg/cm2, the valves 21 and 22 open automatically and the saturated steam starts to charge into the pressure vessel. This way, the pressure within the vessel is fluctuated many times between about 1.2 and 1.8 kg/cm2. It should be noted that when the pressure of the saturated steam charge into the pressure vessel 2 falls below about 3 kg/cm2, the result becomes less effective. Also, when the pressure within the pressure vessel 2 increases to above 1.8 kg/cm2, the originally contained water within the lumber is forced into the core portion and this forced water becomes an obstacle to the uniformity of temperature of the lumber.

When the saturated steam having a temperature higher than that of the the lumber lashes against it, the condensed water having a temperature much higher than that of the water contained within the lumber arises on the surface of it. However, whet, the pressure within the pressure vessel 2 is fluctuated many times between about 1.2 and 1.8 kg/cm2, said condensed high-temperature water on the surface of the lumber is forced into the lumber during the process of pressure raising. During the process of pressure reducing, low-temperature water originally contained within the lumber is forced out onto the surface of said lumber as a reaction against the pressure applied within it. Therefore, by applying this pressure fluctuation within the pressure vessel 2 repeatedly, the high-temperature condensed water and low-temperature originally contained water are mixed. After fifty minutes, which is a half of the time converting the thickness of the lumber measured in mm into minutes, the temperature within the lumber is unified to about 100° C.

As the temperature within the lumber becomes high, even if the pressure within the pressure vessel is raised, the low-temperature water originally contained within the lumber is forced into the core portion, and the occurrence of the low-temperature water lump could be avoided. Therefore, the basic range of pressure fluctuation is raised to between about 1.6 and 2.0 kg/cm2 and the high-temperature condensed water generated on the surface of the lumber and the relatively low-temperature water contained within it will mix on the basis of the above-mentioned principle. The time required for the pressure fluctuation is 100 minutes, which is two times as long as the time calculated by the foregoing calculation method, and thereafter, the temperature within the lumber is unified to 120° C., which is the temperature proportional to the maximum pressure of the saturated steam within the range of the fluctuated pressure.

It should be noted that pressure range of frequent fluctuation and time to fluctuate the pressure should be altered to a little extent according to the types of tree and their usage. This fluctuation range is almost similar to the foregoing figures. Even if said range is altered, the temperature within the lumber becomes proportional to the maximum temperature of the saturated steam fluctuated.

Supplementary explanation of the above temperature is as follows: the temperature of water contained in the vessel within the lumber is easily unified by pressure fluctuation, but the water contained in the cell cavities doesn't change even if the pressure is fluctuated. However, after the lapse of the above-mentioned time, the water contained in the cell cavities also reaches the same temperature by heat transfer from the high temperature water contained in the vessels within the whole lumber.

After the lapse of the time required to unify the temperature within the lumber, the valves 21 and 22 are closed and the saturated steam into the pressure vessel 2 is stopped; simultaneously, the valve 29 is opened more and the steam within the pressure vessel 2 releases, thereby, whole water contained within the lumber 1 boils uniformly. The valve 29 is opend by confirming the attached measuring instrument which indicates the pressure within the pressure vessel 2. It should be noted that when releasing of steam is delayed from the pressure vessel 2, only little amount of contained water boils in the lumber 1, and the heat does not stay. Also, when discharge of steam is too fast, it may cause destruction of lumber. It is inevitable that it varies in the discharge rate of the steam from the pressure vessel 2, depending on the strength of the tissue each kind of lumber possesses.

Since the temperature within the lumber 1 is unified, uniformity is achieved in boiling water throught the whole lumber, therefore, the moisture content within the lumber 1 is reduced uniformly regardless of the thickness of the lumber 1. There are narrow parts of the capillary tubes within tissues of the lumber and pits at the exits of the cell cavities and some of them are so tiny that only water molecules can pass through; and a great difference occurrs in the boiling pressure at both ends of those pits. Therefore, phenomena such as expansion and cracks are observed because of this great difference in pressure. In seasoning lumber, the water contained in the cell cavities which was considered to be difficult to evaporate, boils at the same time, resulting in discharge of vaporized contained water through the nearest cell cavities, and hollows are made in the whole cell cavities.

In this state, after the first process is completed, the lumber taken out of the pressure vessel 2 is cut at ranndom, frozen rapidly below −20° C., and cut out after the whole contained water freezes. The cell cavity is photographed with an electron microscope. The parts in which water is contained are white, and the parts in which the water was evaporated from, are black in the picture thereof. Since the ratio of black parts to white ones is the same in each cell cavity, it is confirmed that hollows arises uniformly in all cell cavities.

When the pressure in the pressure vessel 2 approaches atmospheric pressure the valve 29 is closed and the vacuum pump 9 is started to operate, and at the same time the valve 27 is opened, the pressure within the pressure vessel 2 is reduced below atmospheric pressure, and the evaporated amount of water contained within the lumber 1 is increased. After about 20 minutes, the valve 27 is closed, the vacuum pump 9 is stopped, and the valve 28 is opened. Then the pressure within the pressure vessel 2 is returned to the atmospheric pressure, the door 3 is opened, and the lumber 1 on the carriage 4 is taken out of the pressure vessel 2. Thus the first process is completed.

The reason for stopping the vacuum pump after 20 minutes of operation is that, through calculating the quantity of heat given to the lumber 1 by the saturated steam and the amount of heat needed to evaporate water at the time the pressure is reduced to atmospheric pressure, if the vacuum pump is operated any longer, the risk of losing the heat that boils the water contained in the lumber 1 arises, evaporated water on the surface of the lumber is absorbed, and water gradient occurrs in the lumber 1. Thus, the above-mentioned phenomena contradicts the pretreatment of the first process of this invention to reduce the moisture content in the lumber 1 uniformly, regardless of the thickness of the 1 lumber.

The rate of pressure reduction in the pressure vessel 2 by operating said vacuum pump depends on the initial moisture content as the first process begins. By operating said vacuum pump for about 20 minutes, it is ensured that the time taken to evaporate free water could be shortened within the lumber 1 in the second process. Even if the thickness of the lumber is 100 mm, the time required for the first process to complete is about 3 hours, therefore, 2 cycles can be done within usual working hours.

Moreover, since the first process is a pretreatment for the lumber to prevent cracks and warps from occurring in the following process of seasoning lumber, the reduction rate of moisture content is only reduced by 30% in the first process. However, the reduction rate of moisture content does not vary regardless of the thickness of the lumber and also in the latter process, and the uniformity in reduction rate of moisture content is maintained, therefore, a regulation concept that cracks and warps should occur in the seasoning lumber process becomes void.

Since the first process is a pretreatment of lumber seasoning to reduce the moisture content uniformly, regardless of thickness by fluctuating the pressure of the saturated steam and reducing the pressure for extremely short time just once,the process differs from the previous steaming and vacuum method of reducing moisture content by the repetition of fixed pressurizing and heating process and pressure reducing process of the saturated steam.

After the first process is completed, the lumber 1 taken out of the pressure vessel 2 is passed into the second process to evaporate the free water by natural seasoning with no high cost in a moderate climate district where no extra expense is needed for seasoning.

In regular natural seasoning which pretreatment of process 1 is not applied, moisure contained in the vessels of the tissue within the lumber is easy to evaporate, but water contained behind the extremely narrow part of the capillary tubes and the cell cavities is extremely difficult to evaporate. Since the distribution of moisture content becomes irregular, during natural seasoning, it results in unbalanced shrinkage throughout the lumber, and causes cracks and warps. In the description of the first process, it explained that expansion and cracks in extremely small pits at the exit of the capillary tubes and cell cavities having narrow pits occurs because of the difference in the boiling pressure, therefore, there is no obstacle for the moisture content to evaporate. All lumber seasoning methods regularly adopted in the world now don't apply the process promoting the evaporation of the water contained in the cell cavities.

It is mentioned in the first process that hollows are made in each cell cavity. In the natural seasoning of the second process, not only the free water in the lumber but also the water contained in the cell cavities starts to turn into gas and evaporates. Contrary to this, in a regular lumber which first process is not applied, even if the water contained in the cell cavities turns into gas and evaporates, there is no place to go. Lumber treated by the first process possesses hollows made by the evaporation of the contained water into the nearest cell cavity, therefore, there is a place for the evaporation gas to move into. Thus, the water contained in the all cell cavities can move simultaneously. It was difficult for the water contained in the cell cavities to move simultaneously according to any seasoning lumber method adopted now in the world, but the pretreatment of the first process for seasoning enables that for the first time.

In the natural seasoning of the second process, since the difficulty of evaporationg the contained water is solved, the conventional concept that it is impossible to prevent cracks and warps from occurring in the natural seasoning vanishes, and the occurrence of cracks and warps can be prevented completely. Thereby, even thick lumber can be also seasoned without any cracks.

Also, in the case of thick lumber, the speed of rate of reduction of moisture content is increased about twice or more by using the first process. In the most of the places in the world, inexpensive natural seasoning can be done but in places where the climate is unfavorable and the natural seasoning cannot be done, the only way is to apply the second process for evaporating the free water by using dehumidification seasoning or hot air lumber seasoning at extremely low temperature at regular seasoning cost.

It is necessary to play the second process to remove the free water remaining in the lumber between the first process and the third process, because when the lumber 1 is heated using the current of the superheated steam in the third process, the superheated steam turns into saturated steam immediately while the free water exists,-therefore, using of the superheated steam becomes less effective.

After the free water is removed in the second process, the lumber 1 is loaded on the carriage 4 again and accommodated in the pressure vessel 2, the front door 4 is closed, and the third process is started. It should be noted that both sides of the loaded lumber 1 should be extremely close to the walls of the pressure vessel 2, and all sides of the space; both ends and the top side of the loaded lumber 1 and the space the claw of the fork-lift enters should be sealed with unnecessary lumber.

In the third process, at first, the valves 21, 22, 23 and 29 are opened and the valves 24, 25, 26, 27 and 28 are closed. Then the saturated steam is charged into the vessel about 3 minutes and the surface of the lumber 1 is wetted.

Next, the valve 23 is closed, the valve 24 is opened, and the pressure of the saturated steam from the boiler 6 is reduced down to about 4 kg/cm2 by the pressure reducing valve 8. Their, the steam is heated between 130 and 300 C with the superheater 7 and turned into the superheated steam. It is charged into the pressure vessel 2 through the injection pipes 11 and 12. When the pressure within the vessel 2 reaches about 1.5 kg/cm2, the valve 29 is turned down and the opening is lessened. At the beginning, the minimal temperature of superheated steam within the above-mentioned temperature range is used.

Next, the charge from the injection pipe 12 is stopped by closing the valve 22. Simultaneously, the steam is discharged to the outside from the release pipe 17 by opening the valve 26. Thereby, the horizontal current toward the release pipe 17 is generated by letting the superheated steam from the injection pipe 11 and pass through the space of loaded lumber in the vessel 2. In the space surrounded by the lumber 1 and the vessel 2, since there is a difference in the pressure between the injection pipe side and the release pipe side, the uniform current flows in the space of the loaded lumber 1. Because of the current that results from the pressure difference, irregular current doesn't occur like in the case of the hot air dryer. By slightly increasing the amount of charged steam to that that of the discharged, the pressure within the vessel 2 rises gradually up to about 2.5 kg/cm2. Then changing of the superheated steam is stopped by closing the valve 21, thereby the pressure within the vessel 2 decreases gradually down to about 1.5 kg/cm2. Then said superheated steam is turned into current to pass from the injection pipe 12 through the space around the loaded lumber 1 toward the release pipe 16 by closing the valve 26 and opening the valve 22 and 25. Since the foregoing valves 21, 22, 25 and 26 are solenoid valves, and they operate automatically with the pressure within the vessel, the pressure within said vessel 2 goes automatically back and fro between about 1.5 kg/cm2 and 2.5 kg/cm2, and approximately every three minutes the direction of the current within the vessel reverses between the upper and the lower limits thereof. Since the direction of the current changes approximately every three minutes, no change occurs in quantity of heat given to the lumber 1.

During the process of the pressure rising within vessel 2, similar effect occurs to that of hot air seasoning method using current of superheated steam, therefore, evaporation takes place from the surface of the lumber 1. In the process of the pressure decreasing, similar effect occurs to that of vacuum seasoning method, therefore, boiling and evaporation take place from the inner portion of the lumber 1. Within three minutes, the result is equal to that of combined methods of hot air seasoning and vacuum seasoning, therefore, it gives wet to the lumber, and by applying the first process, unified reduction rate of moisture content can be accelerated.

When this operation is put into effect for about 2 or 3 hours, the moisture content of the lumber is reduced below 22%. Within the whole process of seasoning lumber, the stage of seasoning lumber of which the moisture content is below 22%, is considered most in difficult and painstaking to reduce moisture content since cracks and warps easily occur at this stage. Moreover, in case of seasoning of lumber of which the moisture content is below 22% by applying the conventional process used throughout the world now, the speed of moisture reduction rate slows down, and at the same time, since too much attention is given to the stage when cracks and warps are apt to occur, no measures have been taken to take advantage of the state, differing from that of lumber with high moisture content, which the tissue of lumber 1 becomes firm, and compression does not occur even if applied pressure is raised and damages do not occur even if the heating.

This invention makes full use of advantageous characteristics of lumber having moisture content below 22%. The range of pressure fluctuation within the vessel 2 is raised between about 2.5 kg/cm and about 3.5 kg/cm2, utilizing the first process that the water contained in the lumber can be evaporated uniformly despite the thickness of said lumber. Simultaneously, when the temperature is raised more than that of the superheated steam of the previous operation, the temperature of the current on the surface of the lumber 1 is raised and the speed is accelerated. Therefore, alternate occurrence of the evaporation from the surface portion of the lumber and the boiling evaporation from the core portion of said lumber is also accelerated. When this state is continued for about 3 or 4 hours, the square bars and the widers of lumber 1 having thickness of 100 mm, which is said to be impossible to be seasoned by the lumber seasoning method presently used, have turnd into lumber with unified moisture content of approximate 12% within the whole lumber. Then the valve 22 is closed and the valve 29 is opened more, making the pressure within the vessel 2 into atmospheric pressure. Then door 3 is opened and the lumber 1 is taken out.

This becomes seasoned lumber with unified moisture content with no water gradient. It can be contrasted to seasoned lumber applying the conventional seasoning method in which the moisture content increases radially toward the core portion of lumber.

Possibility of Utilization in Industry

According to the all lumber seasoning methods conventionally used in the world now, it takes several days for lumber to be seasoned. But in the final treatment of the third process, it only takes about 6 hours within usual working hours to complete seasoning the lumber without occurrence of any cracks and warps, thereby, the turnover ratio of the dryer can be raised extremely.

As described hereinbefore, since the characteristics of the present invention is to get rid of the nature of lumber which evaporates disproportionate contained water, before beginning of seasoning, the method in which moisture content can be reduced uniformly throughout the lumber is achieved, thus, said lumber is able to be seasoned without any cracks and warps. In addition, all problems taken up in the background of the invention described at the beginning are possible to be solved.

In the process of seasoning lumber, realizing of lumber seasoning without the occurrence of any loss of cracks and warps means reduction of cutting down of trees and is useful, not only in economizing on lumber business, but also in protecting forest resources and conservation of global environment. The lumber has the nature to warp towards the opposite side of the core of raw wood during the seasoning, and the flat lumber has the nature to warp like a cup. However, during the pretreatment of the first process which prevents from the occurrence of cracks and warps using saturated steam, an advantageous by-product results; that is, the said lumber is seasoned keeping the straightness of the lumber due to the weight thereof. In the seasoning method of this invention, pretreatment of first process can be operated twice within usual working hours even with the thickness of 100 mm, and the final seasoning can be finished in 6 hours within said usual working hours with no cracks and warps. In the second process, dryer is not used to evaporate the free water without the occurrence of cracks and warps, thereby, the turnover ratio of the dryer is increased, resulting in by-product which reduces the depreciation cost, fuel, and personal expenses substantially.

Since the limitation of the thickness of the lumber has become void, which was impossible to be seasoned according to the conventional lumber seasoning methods used in the world, after seasoning the lumber, it can be cut in the desired thickness for use and the yield can be increased.

The contained water can be evaporated uniformly despite the complicated tissues structure within the lumber, and the present invention adopts extremely high temperature and pressure beyond the common usage in the convenntional lumber seasoning methods, therefore, a technical innovation is considered to occur in the lumber industry using this procedure of the present invention.

The abovementioned embodiments are described so as to illustrate the present invention and are not to be construed to limit the scope of the invention; it is to be understood that variations may be made by one skilled in the art within the scope of the invention defined by the accompanying claims.

What is claimed:

1. A method of seasoning lumber comprising the steps of;

(a) first, placing the lumber in a pressure vessel, charging and discharging saturated steam into and out of the pressure vessel in order to fluctuate the pressure in the vessel until the inner temperature of the lumber becomes uniform, and thereafter discharging the saturated steam from the pressure vessel, while maintaining the temperature uniform in order to boil and evaporate the water contained in each tissue of the lumber, to form the lumber into a condition which can be seasoned uniformly by additional steps;

(b) second, taking the lumber out of the pressure vessel until free water contained in the lumber evaporates therefrom; and (c) third, placing the lumber containing no free water back into the pressure vessel to heat the lumber in a pressurized condition by using a flow of superheated steam until the remaining water is evaporated from the lumber.

2. The method of seasoning lumber according to the claim 1, wherein the first step (a) includes the following steps;

(a-1 unifying the temperature of water contained in lumber, enabling it to boil by atmospheric pressure by increasing and decreasing the pressure of the saturated steam within a pressure range of 1–2 atm., after the lumber is heated so that originally contained water with a low temperature is prevented from concentrating at the core portion of the lumber by increasing and decreasing the pressure of saturated steam with the pressure range of 1–2 atm. by controlling of the charge and discharge of saturated steam in the vessel;

(a-2 discharging the steam from the pressure vessel and decreasing the pressure thereof until it reaches atmospheric pressure, and boiling the water contained in every tissue of the lumber, thus providing lumber which has balanced water evaporation.

3. The method of seasoning lumber according to the claim 1, wherein the third step includes, frequently repeating increasing and decreasing the pressure in the vessel within a fixed range by controlling the charge and discharge of superheated steam so that a flow of the superheated steam is generated in the vessel.

4. The method of seasoning lumber according to claim 1, wherein the lumber without the free water which was evaporated in the second step and is to be processed additionally in the third step has a moisture content up to 22%, and the third is carried out so that as the moisture content decreases from the lumber, the tissues of the lumber are hardened, the pressure of the superheated steam is raised so that evaporation of the water remaining in the lumber is accelerated.

5. The method of seasoning lumber according to the claim 1, wherein the third step performed at a minimum limit of a fixed pressure range, so that the superheated steam reverses its direction of flow.

6. The method of seasoning lumber according to the claim 1, wherein the third step includes using the superheated steam with a temperature of 160° to 300° C., pressure of about 1.0 to 4.0 kg/cm2, and a pressure fluctuation range of about 0.8 to 1.24 kg/cm2, so that water on the surface of the lumber is evaporated as the pressure increases, and water contained in the lumber is extracted therefrom as the pressure decreases.

7. The method of seasoning lumber according to the claim 1, wherein the first step is performed at a low pressure range of about 1.2 to 1.8 kg/cm2 and relatively high pressure range of about 1.6 to 2.0 kg/cm2, so that high temperature water on the surface of lumber is forced into the inner portion of lumber as the pressure increases, and low temperature water contained in the lumber is forced out from the lumber as the pressure decreases so as to make the temperature of the lumber totally uniform.

8. A lumber product seasoned by the steps according to claim 1.

* * * * *